United States Patent [19]

Tagashira

[11] 4,258,360

[45] Mar. 24, 1981

[54] OPTICAL SMOKE DETECTOR

[75] Inventor: Hiroshi Tagashira, Chofu, Japan

[73] Assignee: Nittan Company, Limited, Tokyo, Japan

[21] Appl. No.: 929,714

[22] Filed: Jul. 31, 1978

[30] Foreign Application Priority Data

Sep. 2, 1977 [JP] Japan ..... 52-105519

[51] Int. Cl.[3] ..... G08B 17/10

[52] U.S. Cl. ..... 340/630; 250/574

[58] Field of Search ..... 240/630; 250/573, 574, 250/575, 564; 356/438, 439

[56] References Cited

U.S. PATENT DOCUMENTS

| | | | |
|---|---|---|---|
| 2,877,453 | 3/1959 | Mendenhall, Jr. | 340/630 |
| 3,316,410 | 4/1967 | Meili et al. | 340/630 X |
| 3,543,260 | 11/1970 | Engh | 340/630 X |
| 3,946,241 | 3/1976 | Malinowski | 340/630 X |

*Primary Examiner*—John W. Caldwell, Sr.
*Assistant Examiner*—Daniel Myer
*Attorney, Agent, or Firm*—Eugene E. Geoffrey, Jr.

[57] ABSTRACT

An optical smoke detector which includes a light source and light sensing element so arranged that the quantity of light detected by the element will be determined by the presence of smoke in the detector, a power source for periodically supplying sets of actuating pulses to the light source, apparatus connected with the light sensing element for detecting light pulses which are synchronized with the actuating pulses and producing an alarm when pulses of a predetermined magnitude are detected.

1 Claim, 2 Drawing Figures

OPTICAL SMOKE DETECTOR

Figure 1:
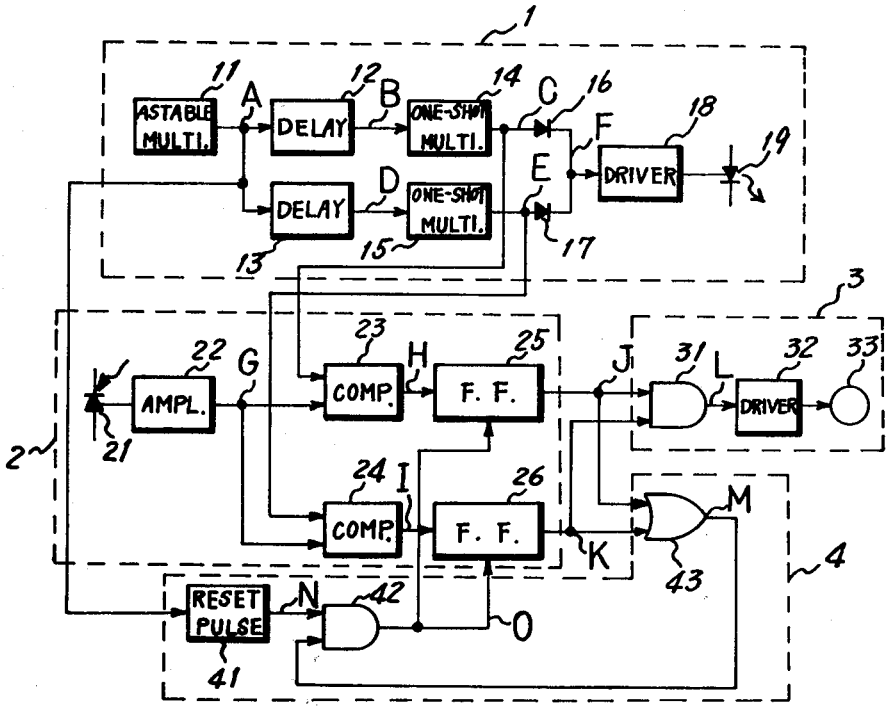

This invention relates to an optical smoke detector which is generally used for sensing aerosols such as smoke produced by a fire or the like. Particularly, this invention relates to an improvement in the light emitting and sensing system of such types of smoke detectors.

The optical smoke detector generally includes a light source and a light sensing element within a chamber permitting entrance of smoke. The light source and light sensing element are arranged so that the latter receives light from the former which has been scattered by the smoke particles or has penetrated therethrough and senses the smoke through a change in the amount of received light. U.S. Pat. No. 3,555,532 granted to G. S. White et al discloses such a type of smoke detector in which the light source is actuated with a current pulse, for example, once every second in order to save power consumption and also to prolong lifetime of the light source. However, such an optical smoke detector of pulse-actuated type has had a severe problem in that it is easily affected by noise signals which can produce an erroneous alarm.

Accordingly, an object of this invention is to provide an improved optical smoke detector of pulse-actuated type, which is relatively unaffected by noise signals and exhibits high reliability.

In addition to the light source and light sensing element, the optical smoke detector according to this invention includes means for supplying two actuating pulses successively occurring within a predetermined period to the light source to make it to flash twice within this period, means for detecting output pulses of the light sensing element which are synchronous with the actuating pulses, and means for producing an alarm signal in response to detection of two successive synchronous pulses by the detecting means.

Other objects and advantages of the device of this invention will become more apparent from the following description and accompanying drawings forming part of this application.

Figure 2:
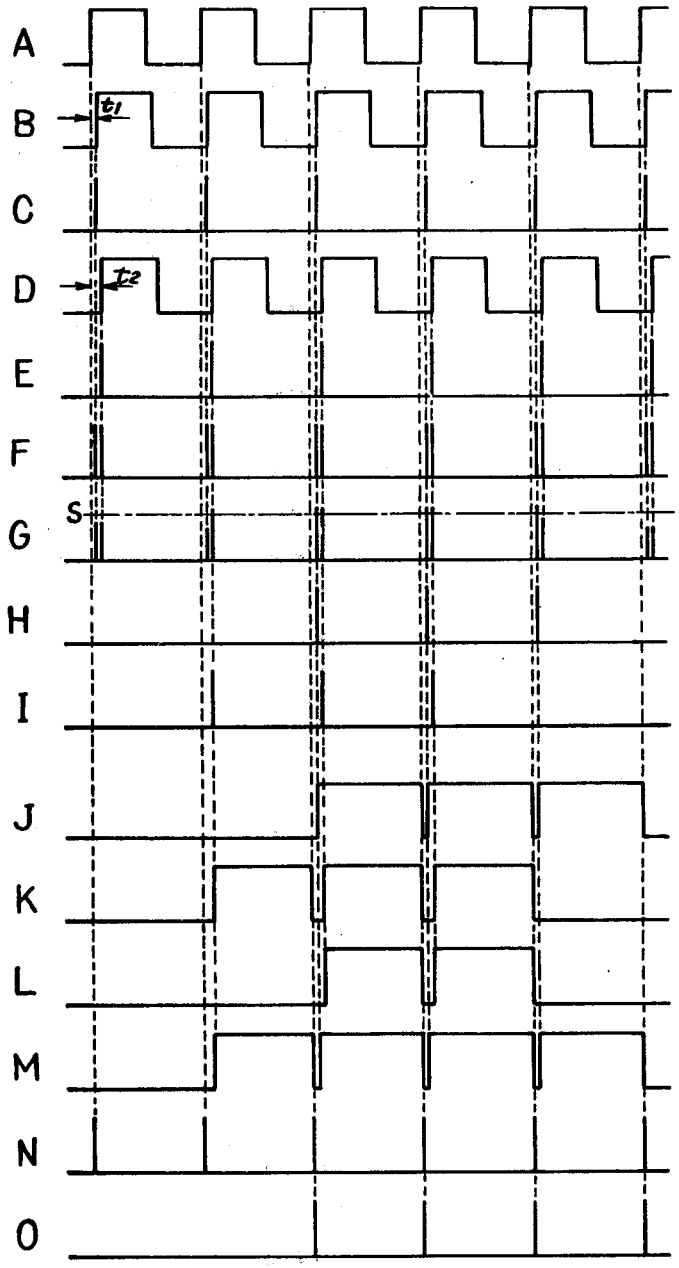

IN THE DRAWINGS:

FIG. 1 is a schematic block circuit diagram of one embodiment of electric circuitry of the optical smoke detector according to this invention; and FIG. 2 is a waveform diagram representing various signal waveforms appearing in the circuitry of FIG. 1.

Referring to FIG. 1, the optical smoke detector of this invention comprises a light emitting section 1, a light sensing section 2, an alarm producing section 3 and a reset pulse generating section 4. In the light emitting section 1, there is provided an astable multivibrator circuit 11, the output of which is coupled to inputs of two delay circuits 12 and 13 having different delay times. The outputs of the delay circuits 12 and 13 are respectively coupled through one-shot multivibrators 14 and 15 and diodes 16 and 17 to a light source driving circuit 18 the output of which is coupled to a light source 19 such as a light emitting diode. The light sensing section 2 includes a light sensing element 21 such as a photodiode the output of which is coupled through an amplifier circuit 22 to one input of each of two comparator circuits 23 and 24. The other inputs of circuits 23 and 24 are respectively coupled to the outputs of the one-shot multivibrator circuits 14 and 15. The outputs of the comparators 23 and 24 are coupled to inputs of two flip-flop circuits 25 and 26, respectively. The alarm producing circuit 3 includes an AND circuit 31 having two inputs supplied from the outputs of the flip-flop circuits 25 and 26. The output of the AND circuit 31 is coupled through an alarm driving circuit 32 to an alarm device such as buzzer or bell 33. The reset pulse generating section 4 includes a pulse generator circuit 41 having an input coupled to the output of the astable multivibrator circuit 11 and an output coupled to one input of an AND circuit 42. An OR circuit 43 has two inputs connected to the outputs of the flip-flop circuits 25 and 26, respectively, and an output connected to another input of the AND circuit 42. The output of the AND circuit 42 is connected to reset terminals of the flip-flop circuits 25 and 26, respectively.

Now, the operation of the circuit of FIG. 1 will be described with reference to FIG. 2 in addition to FIG. 1.

In operation, the astable multivibrator circuit 11 produces a rectangular wave signal A having a period of about five seconds, for example. The output signal A is delayed by the delay circuits 12 and 13 having different delay times $t_1$ and $t_2$, respectively, and the delay circuits 12 and 13 produce delayed rectangular wave signals B and D. For instance, the delay times $t_1$ and $t_2$ are 0.05 second and 0.15 second respectively. The signals B and D trigger the one-shot multivibrator circuits 14 and 15, respectively, to produce trains of pulses C and E having a pulse width of about 100 microseconds, for example. The signals C and E are combined through diodes 16 and 17 to form a dual pulse train F. The diodes 16 and 17 serve to block backward currents to the multivibrator circuits 14 and 15. The driving circuit 18 supplies actuating current to the light source 19 in response to the dual pulses to cause it to flash twice within a relatively short time interval, $t_2 - t_1$, that is 0.1 second, for example.

The light emitted from the light source 19 is received by the light sensing element 21 the output of which is in turn amplified by the amplifier circuit 22. As the light emitted from the light source 19 is scattered and absorbed by the smoke particles when they exist, the output signal G from the amplifier circuit 22 has some difference in pulse amplitude from the light source actuating signal F. Assuming now that this embodiment is arranged to sense the scattered light and, therefore, the detection signal amplitude increases with an increase of the smoke concentration, the waveform G means that the smoke concentration is highest at the central two sets of dual pulses. This invention intends to produce an alarm only for the cycles to which these dual pulses belong, thereby avoiding interference of random noise signals.

For this purpose, the pulses in the waveform G having amplitudes below a predetermined level S are removed in the comparator circuits 23 and 24 and the remaining pulses are compared in phase with the pulses C and E, thereby producing outputs H and I, respectively, as readily understood from the waveform G. The pulse outputs H and I trigger the flip-flops 25 and 26, respectively, to produce high level signals J and K, respectively. The both signals J and K are coupled by the AND circuit 31 to form a driving signal L. The alarm device 33 is actuated through the driver circuit 32 by this driving signal L to produce an alarm for two cycle times as shown, in this case.

The output signals J and K of both flip-flop circuits 25 and 26 are also processed by the OR circuit 43 to produce a high level output as shown by waveform M.

Furthermore, the pulse generator 41 produces a pulse train N in response to the leading edges of the rectangular wave signal A from the astable multivibrator 11. The signals M and N are coupled by the AND circuit 42 to produce output pulses 0. The pulses 0 are applied to reset terminals of the flip-flop circuits 25 and 26 to reset the both flip-flop circuits in synchronism with the leading edges of the signal A.

As described above, according to this invention, noise signals which are generally composed of single discrete pulses are removed from the alarm circuit. Moreover, by the function of the comparator circuits 23 and 24, low level pulses below the reference level S are also removed, so that erroneous actuation of the alarm due to low smoke concentration as caused by a cigarette can be avoided.

It should be noted that the above description has been made for illustrative purpose only and various modification and changes can be made without departing from the scope of the invention as defined in the appended claim. For example, the above description has been made in conjunction with an optical smoke detector of light scattering type. More particularly, in this embodiment, the amount of light received by the light sensing element increases with increase of the smoke concentration. However, this invention is also applicable to light penetration types. In the latter case, the amount of light received by the light sensing element decreases with increase of the smoke concentration. It is easily understood that, in this case, the comparators 23 and 24 may be arranged to remove pulses having amplitudes exceeding a predetermined level rather than below a predetermined level. Furthermore, the circuit can be arbitrarily modified to execute the same function. For example, the waveforms C and E can be produced by utilizing a clock pulse generator and appropriate frequency dividers instead of the astable multivibrator 11 and one-shot multivibrators 14 and 15. What is claimed:

1. An optical smoke detector, comprising a chamber permitting entrance of smoke, a light source for emitting a light in said chamber, a light sensing element in said chamber for converting incident light produced by the presence of smoke in said chamber into an electrical signal, an alarm device for producing an alarm in response to said electric signal, means for generating a train of dual actuating pulses with said dual pulses occurring within a predetermined period of time and applying said dual pulses to said light source to flash it twice within said period of time, means for detecting dual pulses produced by said light sensing element synchronously with said dual actuating pulses and means for producing an alarm driving signal in response to detection of said dual pulses which are synchronous with said dual actuating pulses.

* * * * *